US009454116B2

(12) United States Patent
Okada

(10) Patent No.: US 9,454,116 B2
(45) Date of Patent: Sep. 27, 2016

(54) FIXING DEVICE INCLUDING A FIXING MEMBER TO WHICH HEAT RESISTANT COATING IS APPLIED AND IMAGE FORMING APPARATUS

(71) Applicant: KYOCERA Document Solutions Inc., Osaka (JP)

(72) Inventor: Seiji Okada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/986,956

(22) Filed: Jan. 4, 2016

(65) Prior Publication Data

US 2016/0202645 A1 Jul. 14, 2016

(30) Foreign Application Priority Data

Jan. 14, 2015 (JP) ..... 2015-004629

(51) Int. Cl.
*G03G 15/20* (2006.01)

(52) U.S. Cl.
CPC .. *G03G 15/2057* (2013.01); *G03G 2215/2054* (2013.01)

(58) Field of Classification Search
CPC ..... G03G 15/2057; G03G 2215/2048; G03G 2215/2054
USPC ..... 399/330, 333; 219/216
See application file for complete search history.

(56) References Cited

U.S. PATENT DOCUMENTS

2006/0222423 A1* 10/2006 Dejong ..... F28D 15/046 399/333

FOREIGN PATENT DOCUMENTS

| | | | |
|---|---|---|---|
| JP | 08123232 A | * | 5/1996 |
| JP | 10-240059 A | * | 9/1998 |
| JP | 2002268419 A | * | 9/2002 |
| JP | 2003149976 A | * | 5/2003 |
| JP | 2007025265 A | * | 2/2007 |
| JP | 2011-141453 A | | 7/2011 |

* cited by examiner

*Primary Examiner* — Robert Beatty
(74) *Attorney, Agent, or Firm* — Studebaker & Brackett PC

(57) ABSTRACT

A fixing device includes a fixing member, a pressuring member and a heater. The fixing member is configured to be rotatable. The pressuring member is configured to be rotatable and to come into pressure contact with the fixing member so as to form a fixing nip. The heater is arranged inside the fixing member. A heat resistant coating to convert light from the heater into heat is applied to an inner face of the fixing member, and the coating is formed by using an inorganic material.

10 Claims, 7 Drawing Sheets

FIXING DEVICE INCLUDING A FIXING MEMBER TO WHICH HEAT RESISTANT COATING IS APPLIED AND IMAGE FORMING APPARATUS

INCORPORATION BY REFERENCE

This application is based on and claims the benefit of priority from Japanese patent application No. 2015-004629 filed on Jan. 14, 2015, the entire contents of which are incorporated herein by reference.

BACKGROUND

The present disclosure relates to a fixing device configured to fix a toner image onto a recording medium and an image forming apparatus including the fixing device.

Conventionally, an electrographic image forming apparatus, such as a copying machine or a printer, includes a fixing device configured to fix a toner image onto a recording medium, such as a sheet.

For example, there is a fixing device including a fixing member, a pressuring member configured to come into pressure contact with the fixing member so as to form a fixing nip, and a heater arranged inside the fixing member. According to such a fixing device, a heat absorbing coating may be applied to an inner face of the fixing member.

There is a case where an organic material including methyl silicone is used as the heat absorbing coating. In the case where the organic material including the methyl silicone is used, a volatile component, which is contained in silicone resin and is called "low molecular siloxane", may be generated, even though a generation amount of benzene is restrained. There is a case that the low molecular siloxane is designated as VOC (Volatile Organic Compounds) in standards to urge environmental conservation and is considered to be a cause of generation of UFP (Ultra Fine Particle). Accordingly, it is preferable that a generation amount of the low molecular siloxane should be small. However, it is difficult for above-mentioned conventional art to sufficiently restrain generation of the low molecular siloxane.

SUMMARY

In accordance with an embodiment of the present disclosure, a fixing device includes a fixing member, a pressuring member and a heater. The fixing member is configured to be rotatable. The pressuring member is configured to be rotatable and to come into pressure contact with the fixing member so as to form a fixing nip. The heater is arranged inside the fixing member. A heat resistant coating to convert light from the heater into heat is applied to an inner face of the fixing member, and the coating is formed by using an inorganic material.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Figure 1:
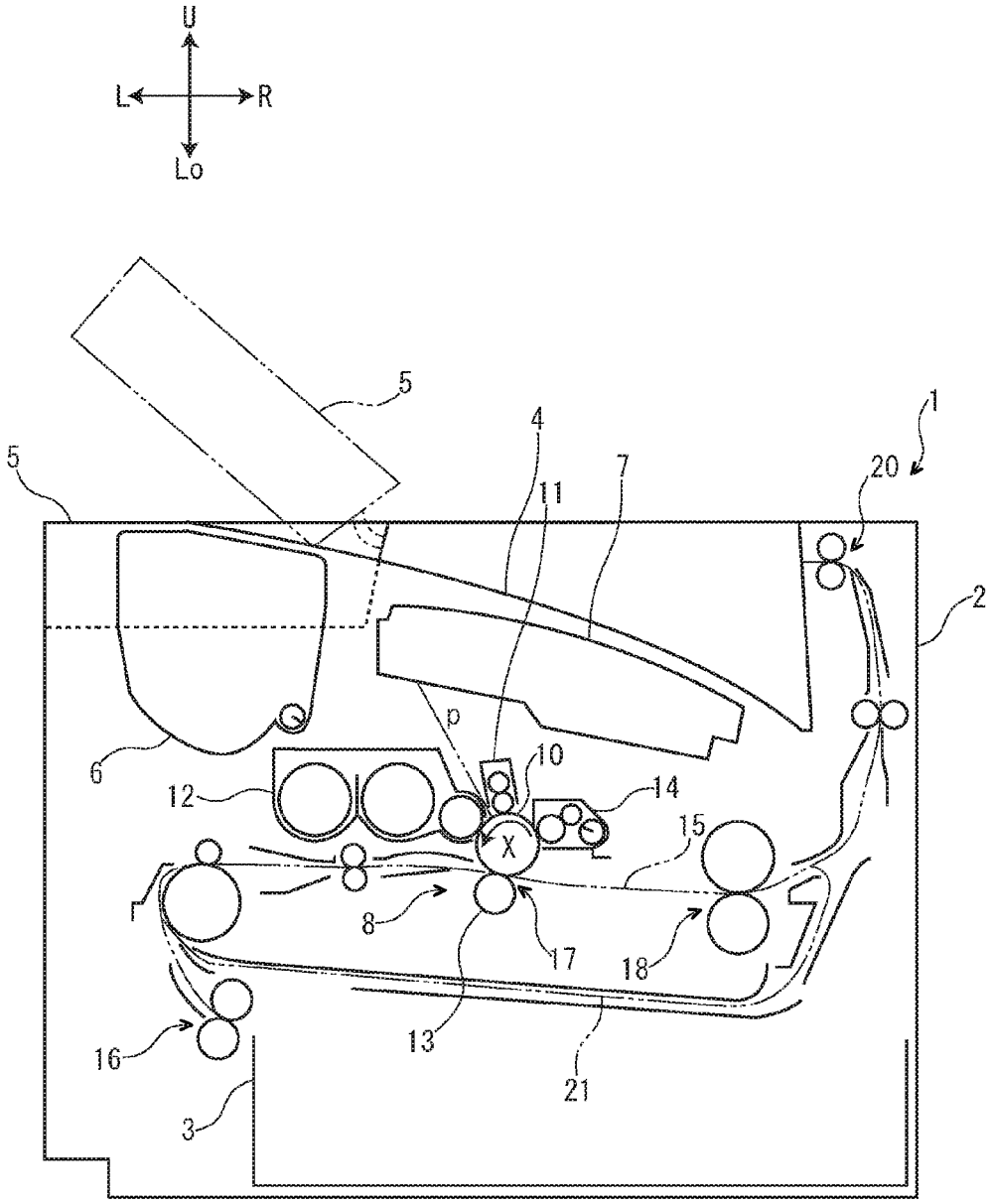
FIG. 1 is a schematic view showing an outline of a printer according to an embodiment of the present disclosure.

First, with reference to FIG. 1, the entire structure of an electrographic printer 1 (an image forming apparatus) will be described. Hereinafter, it will be described so that the front side of the printer 1 is positioned at the front side of FIG. 1. Arrows Fr, Rr, L, R, U and Lo appropriately added to each of the drawings indicate the front side, rear side, left side, right side, upper side and lower side of the printer 1, respectively.

The printer 1 includes a box-formed printer main body 2. In a lower part of the printer main body 2, a sheet feeding cartridge 3 configured to store sheets (recording medium) is installed and, on the top surface of the printer main body 2, a sheet ejecting tray 4 is mounted. On the top surface of the printer main body 2, an upper cover 5 is openably/closably attached at a left-hand side of the sheet ejecting tray 4 and, below the upper cover 5, a toner container 6 is installed.

In an upper part of the printer main body 2, an exposure device 7 composed of a laser scanning unit (LSU) is installed below the sheet ejecting tray 4. Below the exposure device 7, an image forming unit 8 is installed. In the image forming unit 8, a photosensitive drum 10 as an image carrier is rotatably installed. Around the photosensitive drum 10, a charger 11, a development device 12, a transfer roller 13 and a cleaning device 14 are located along a rotating direction (refer to arrow X in FIG. 1) of the photosensitive drum 10.

Inside the printer main body 2, a sheet conveying path 15 is arranged. At an upper stream end of the conveying path 15, a sheet feeder 16 is positioned. At an intermediate stream part of the conveying path 15, a transferring unit 17 constructed of the photosensitive drum 10 and transfer roller 13 is positioned. At a lower stream part of the conveying path 15, a fixing device 18 is positioned. At a lower stream end of the conveying path 15, a sheet ejecting unit 20 is positioned. Below the conveying path 15, an inversion path 21 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data on the photosensitive drum 10 is carried out by a laser (refer to two-dot chain line P in FIG. 1) from the exposure device 7, thereby forming an electrostatic latent image on the surface of the photosensitive drum 10. Subsequently, the electrostatic latent image is developed to a toner image with a toner (a developer) in the development device 12.

On the other hand, a sheet fed from the sheet feeding cartridge 3 by the sheet feeder 16 is conveyed to the transferring unit 17 in a suitable timing for the above-mentioned image forming operation, and then, the toner image on the photosensitive drum 10 is transferred onto the sheet in the transferring unit 17. The sheet with the transferred toner image is conveyed to a lower stream on the conveying path 15 to go forward to the fixing device 18, and then, the toner image is fixed on the sheet in the fixing device 18. The sheet with the fixed toner image is ejected from the sheet ejecting unit 20 to the sheet ejecting tray 4. Toner remained on the photosensitive drum 10 is collected by the cleaning device 14.

Next, the fixing device 18 will be described in detail with reference to FIG. 2. Arrow Y in FIG. 2 indicates a sheet conveying direction.

The fixing device 18 mainly includes a fixing frame 22, a fixing roller 23 (fixing member) housed in an upper part of the fixing frame 22, a pressuring roller 24 (pressuring member) housed in a lower part of the fixing frame 22, and a halogen lamp 25 (heater) housed in the fixing roller 23.

The fixing frame 22 is formed in a box shape. At a center of a left end part of the fixing frame 22, an inlet opening part 27 is formed, and, at a center of a right end part of the fixing frame 22, an outlet opening part 28 is formed. Further, a sheet having entered the fixing frame 22 via the inlet opening part 27 is configured to be ejected from the fixing frame 22 via the outlet opening part 28.

Figure 2:
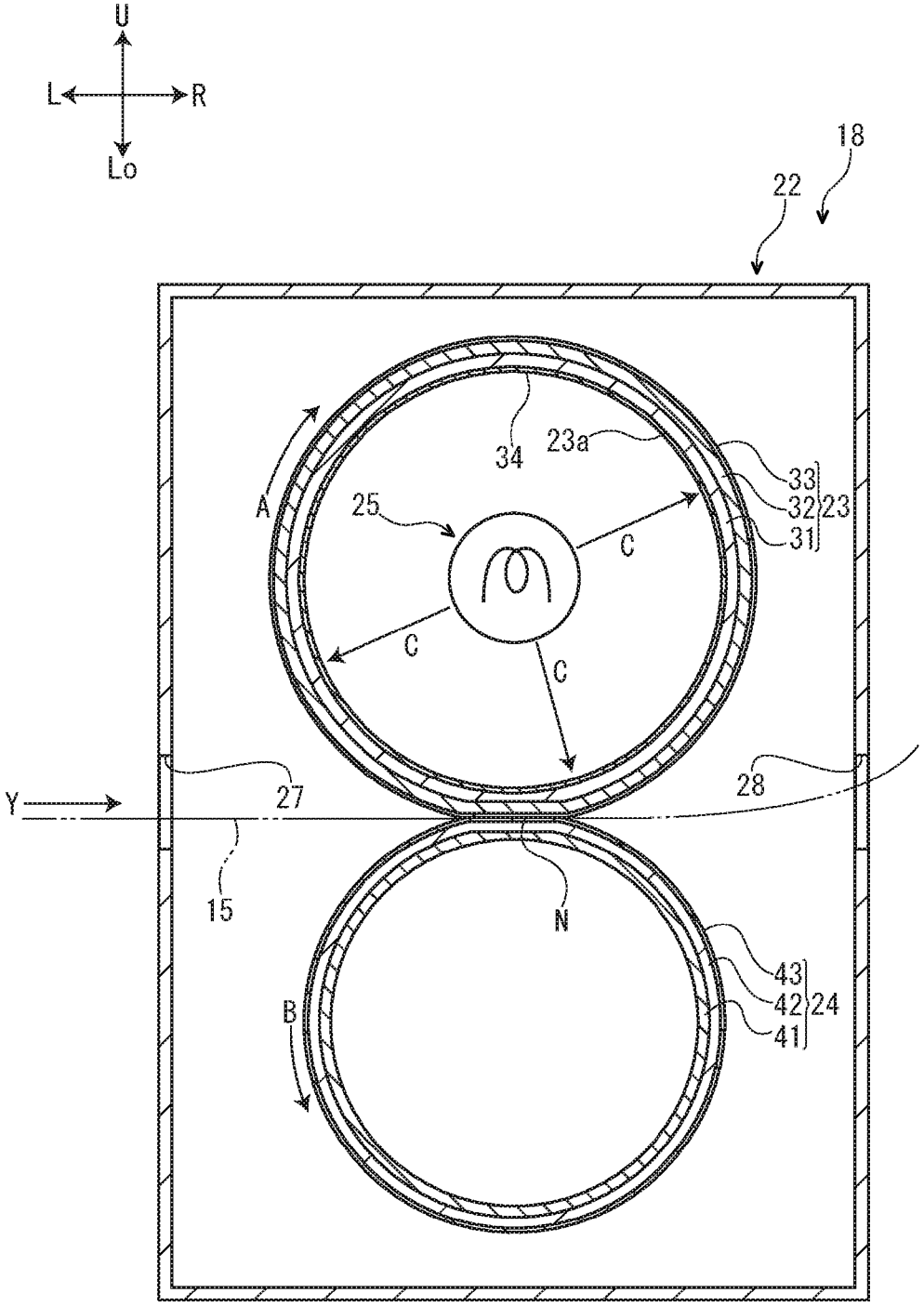
FIG. 2 is a sectional view showing a fixing device according to the embodiment of the present disclosure.

The fixing roller 23 is formed in a cylindrical shape elongated in front and rear direction (a depth direction in FIG. 2). The fixing roller 23 is rotatably supported by the fixing frame 22.

The fixing roller 23 includes a base material layer 31 formed in a cylindrical shape and made of metal, such as aluminum or iron, an elastic layer 32 provided around this base material layer 31 and made of silicon rubber or the like, and a release layer 33 covering this elastic layer 32 and made of a fluorine resin, such as a PFA (Per Fluoro Alkoxy). In addition, in other different embodiments, the fixing roller 23 may not include the elastic layer 32.

To an inner face 23*a* of the base material layer 31 of the fixing roller 23 (hereinafter, referred to as the "inner face 23*a* of the fixing roller 23"), a heat resistant coating 34 is applied. The coating 34 is an aqueous coating which uses not an organic solvent (for example, toluene) but distilled water as a solvent and uses an inorganic material as a colorant. The above-mentioned inorganic material means a material composed of an inorganic element, such as silica, carbon black, metal or the like. For example, the coating 34 is made by mixing 20 wt. % of silica whose particle diameter range is 5 nm to 100 nm, 25 wt. % of the distilled water, 35 wt. % of a coloring pigment composed of a Mn oxide and a black pigment, and 20 wt. % of an extender pigment, such as alumina, bentonite, mica, muscovite, phlogopite or nepheline-Sinait. That is, the coating 34 is composed only of the silica, the distilled water, the coloring pigment and the extender pigment. Further, a weight proportion of the coloring pigment is the largest among elements of the coating 34, a weight proportion of the distilled water is the second largest among the elements of the coating 34, and a weight proportion of the silica and a weight proportion of the extender pigment are the smallest among the elements of the coating 34. The coating 34 is composed only of a single layer.

The coating 34 is applied to the inner face 23*a* of the fixing roller 23, and then is calcined at a predetermined calcination temperature T. There is a concern that, when the calcination temperature T is less than 200° C., the coating 34 becomes uneven, and, when the calcination temperature T exceeds 500° C., the fixing roller 23 is deformed. Hence, to prevent deformation of the fixing roller 23 and uniformly apply the coating 34 to the inner face 23*a* of the fixing roller 23 without non-uniformity of the coating 34, the calcination temperature T preferably satisfies a formula of 200° C.≤CT≤500° C.

The pressuring roller 24 is formed in a cylindrical shape elongated in the front and rear direction (the depth direction in FIG. 2). The pressuring roller 24 is rotatably supported by the fixing frame 22. A biasing force of a biasing member (not shown) causes the pressuring roller 24 to come into pressure contact with the fixing roller 23 so as to form a fixing nip N between the fixing roller 23 and the pressuring roller 24.

The pressuring roller 24 includes a base material layer 41 which is formed in a cylindrical shape and composed of metal, such as aluminum or iron, an elastic layer 42 provided around this base material layer 41 and made of silicon rubber, for example, a release layer 43 covering this elastic layer 42 and made of a fluorine resin, such as PFA (Per Fluoro Alkoxy).

The halogen lamp 25 is housed in a center part of an internal space of the fixing roller 23, and penetrates through the fixing roller 23.

When a toner image is fixed onto a sheet in the fixing device 18 configured as described above, a drive source (not shown) rotates the fixing roller 23 (see arrow A in FIG. 2). When the fixing roller 23 is rotated, the pressuring roller 24 which comes into pressure contact with the fixing roller 23 is driven by the fixing roller 23 to rotate (see arrow B in FIG. 2).

Further, when a toner image is fixed onto a sheet, the halogen lamp 25 is lighted up. When the halogen lamp 25 is lighted up in this way, light is radiated from the halogen lamp 25 (see arrow C in FIG. 2). The light from this halogen lamp 25 is converted into heat by the coating 34 applied to the inner face 23*a* of the fixing roller 23, and is absorbed by the fixing roller 23. Thus, the halogen lamp 25 heats the fixing roller 23. When a sheet onto which an unfixed toner image passes through the fixing nip N, a toner image and a sheet are heated and pressured, so that the toner image is fixed onto the sheet.

In the present embodiment, as described above, a "roller fixing method" of forming the fixing nip N by a pair of rollers (the fixing roller 23 and the pressuring roller 24) is applied. This roller fixing method is generally applied to an image forming apparatus of an electrographic method, irrespectively of a color machine or a monochrome machine.

Further, in the present embodiment, the coating 34 is applied to the inner face 23*a* of the fixing roller 23, and this coating 34 is formed by using an inorganic material. By applying such a configuration, compared to a case where the coating 34 is formed by using an organic material containing silicones, it is possible to prevent a low molecular siloxane from being generated from the coating 34, and reduce generation amount of VOC (Volatile Organic Compounds) and UFP (UltraFineParticle). Hence, it is possible to reduce a load on environment and easily meet standards to urge environmental conservation.

Further, the coating 34 has a heat resistant property, so that it is possible to prevent deterioration of the coating 34. Consequently, it is possible to prevent a photo-thermal converting function from lowering, and enhance a heating efficiency of the fixing roller 23.

In addition, with regard to the coating 34 composed of a plurality of layers including a base layer and a coating layer, it may be possible to adopt a configuration that only the coating layer is formed by using an inorganic material. However, when such a configuration is applied, it is necessary to apply the coating 34 twice to the inner face 23*a* of the fixing roller 23, and therefore an operation time to apply the coating 34 increases and cost of materials of the coating 34 rises.

Hence, in the present embodiment, the coating 34 is composed only of the single layer. By applying such a configuration, it is possible to reduce the operation time to apply the coating 34, and reduce the cost of the materials of the coating 34.

Further, the coating 34 according to the present embodiment does not include an organic solvent. Consequently, it is not necessary to provide an exhausting device and a deodorizing device, and it is possible to reduce a cost invested for equipment.

Further, the water becomes volatile elements by using the aqueous coating which uses the distilled water as the solvent and the inorganic material as the colorant, so that it is possible to further reduce a load on environment.

Further, the halogen lamp 25 is used as a heater, so that it is possible to realize a desired temperature distribution at low cost.

Further, the fixing roller 23 is used as a fixing member, so that it is possible to prevent deformation of the fixing member.

Figure 3:
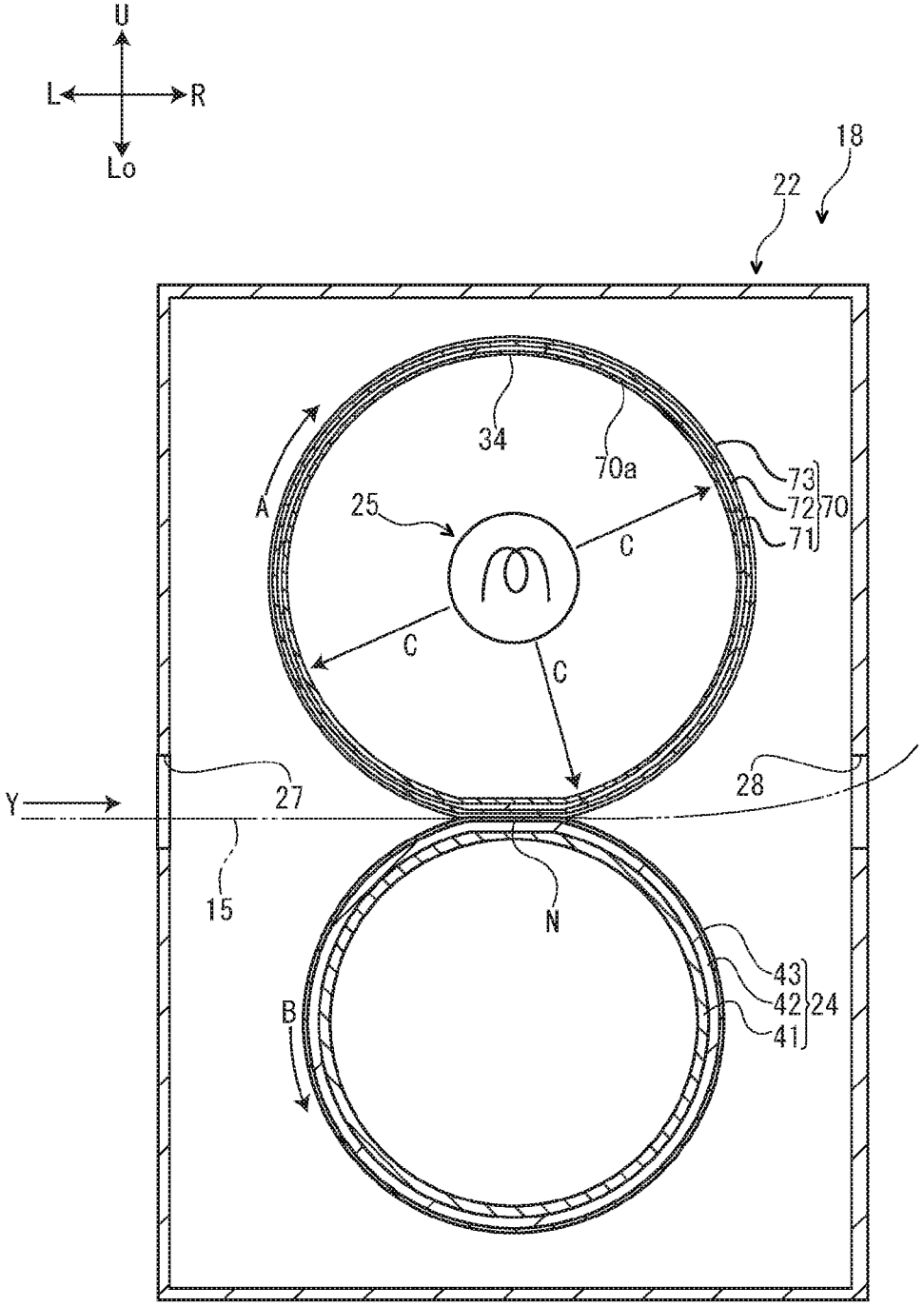
FIG. 3 is a sectional view showing a fixing device according to another embodiment of the present disclosure.

In the present embodiment, the fixing roller 23 is used as the fixing member. Meanwhile, in other different embodiments, as shown in FIG. 3, a flexible fixing belt 70 thinner than the fixing roller 23 may be used as the fixing member. The fixing belt 70 may include a base material layer 71 formed in a cylindrical shape and composed of metal, such as nickel or stainless steel, an elastic layer 72 provided around this base material layer 71 and made of silicon rubber, and a release layer 73 covering this elastic layer 72 and made of a fluorine resin, such as a PFA, and the coating 34 may be applied to the inner face 70*a* of the base material layer 71. In addition, in still other different embodiments, the fixing belt 70 may not include the elastic layer 72. By using the fixing belt 70 as the fixing member as described above, it is possible to reduce a heat capacity of the fixing member, to reduce a warm-up time and to save energy.

Figure 4:
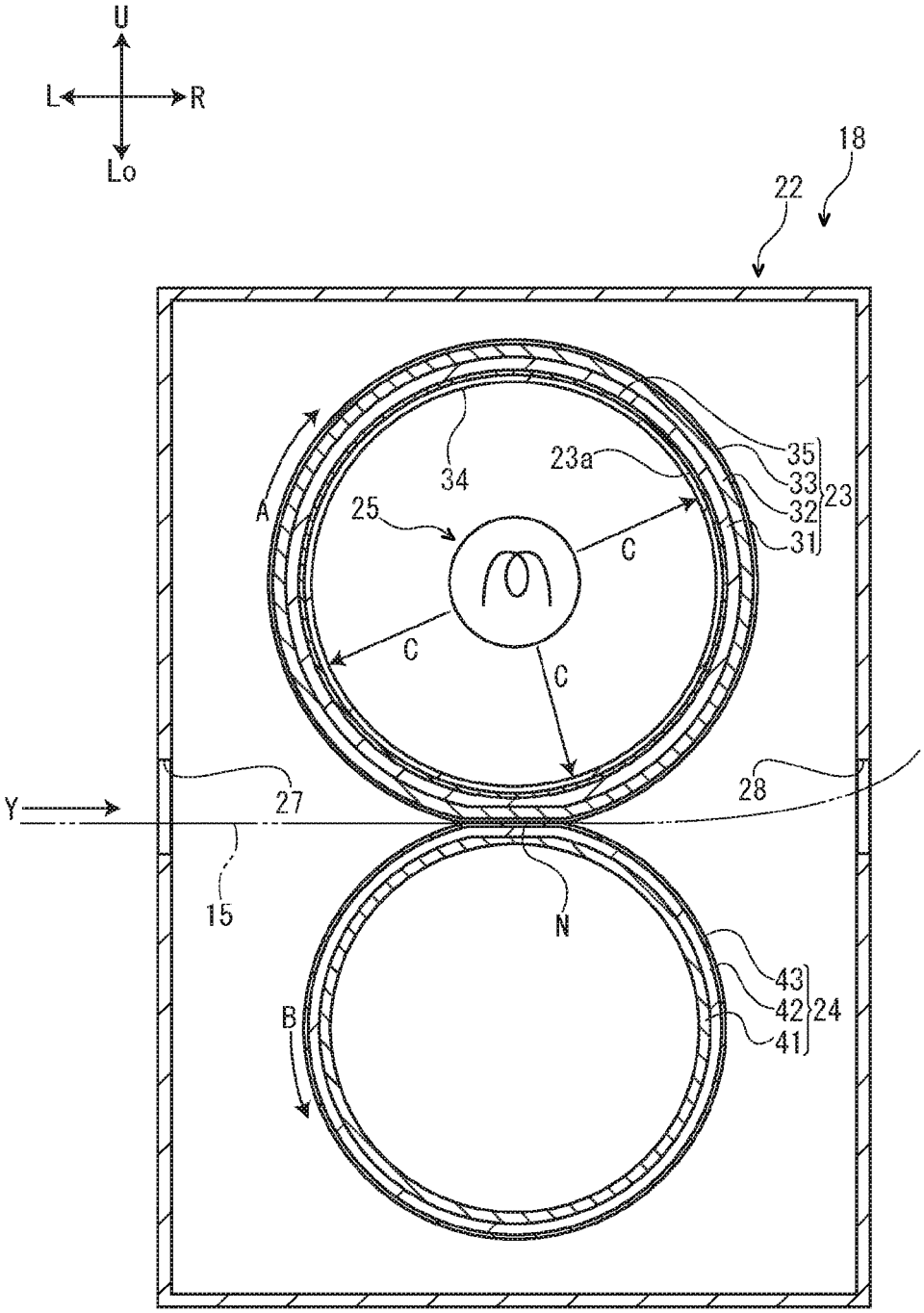
FIG. 4 is a sectional view showing a fixing device according to still another embodiment of the present disclosure.

In the present embodiment, the coating 34 is directly applied to the inner face 23*a* of the base material layer 31 of the fixing roller 23. In other different embodiment, in a case where the base material layer 31 of the fixing roller 23 is composed of aluminum, the fixing roller 23 may be provided with an anodic oxide coating layer 35 by applying alumite treatment to the base material layer 31 of the fixing roller 23, and the coating 34 may be applied on the anodic oxide coating layer 35, as shown in FIG. 4. By applying such a configuration, it is possible to improve affinity of the fixing roller 23 and the coating 34.

In the present embodiment, the coating 34 is composed only of the silica, the distilled water, the coloring pigment and the extender pigment. In such a case, if the extender pigment includes the alumina, the silica and the alumina may be formed by using spherical particles. By using such spherical particles, it is possible to densely pack the particles of the silica and the alumina when the coating becomes a film. Accordingly, it is possible to form a strong film. The particle diameter range of the alumina may preferably be the same as that of the silica.

In the present embodiment, the halogen lamp 25 is used as a heater. In other different embodiments, a heater other than the halogen lamp 25, such as a ceramic heater, may be used as a heater.

In the present embodiment, the configuration of the present disclosure is applied to the printer 1. Meanwhile, in the other different embodiments, the configuration of the disclosure may be applied to another image forming apparatus, such as a copying machine, a facsimile or a multifunction peripheral.

<Experiment>

An experiment was conducted to show the effect of the present disclosure by using the coating according to the example of the present disclosure and coatings according to comparative examples 1 and 2.

(Experiment Device)

Figure 5:
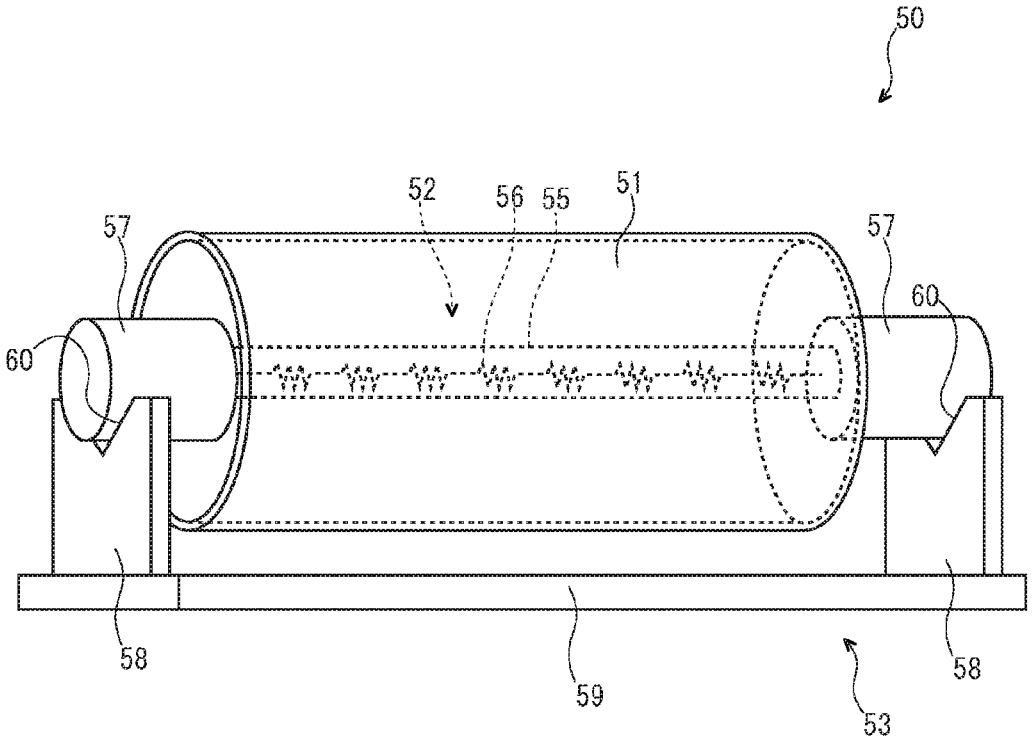
FIG. 5 is a perspective view showing an experiment device.

As shown in FIG. 5, an experiment device 50 which was used for this experiment includes a tube 51, a halogen lamp 52 housed in the tube 51, and a retaining member 53 which retains the halogen lamp 52.

The tube 51 is made of aluminum, and has the length of 260 mm, the diameter of 20 mm and the thickness of 1 mm.

The halogen lamp 52 includes a glass tube 55, a filament 56 housed in the glass tube 55, and retained parts 57 which are fixed to both end parts of the glass tube 55 and are made of ceramic.

The retaining member 53 includes a pair of retaining walls 58, and a coupling wall 59 which couples lower end parts of the retaining walls 58. At an upper end part of each retaining wall 58, a V-shaped groove part 60 is formed, and this groove part 60 retains each retained part 57 of the halogen lamp 52. In addition, each retaining wall 58 is composed of metal, such as, SUS, instead of an organic material. This is because there is a concern that, when each retaining wall 58 is formed by using an organic material, each retaining wall 58 generates VOC or UFP, and the VOC or the UFP may have a great influence on an experiment result.

(Coating)

For example, the coating according to the embodiment of the present disclosure was made by mixing 20 wt. % of silica whose particle diameter range was 5 nm to 100 nm, 25 wt. % of distilled water, 35 wt. % of a coloring pigment composed of a Mn oxide and a black pigment, and 20 wt. % of an extender pigment, such as alumina, bentonite, mica, muscovite, phlogopite or nepheline-Sinait. This coating is formed by using an inorganic material which does not include an organic compound. Further, this coating is an aqueous coating using water as a solvent.

The coating according to comparative example 1 was made by mixing 20 wt. % of methyl silicone resin, 40 wt. % of toluene, 15 wt. % of a coloring pigment composed of a Mn oxide and a black pigment and 25 wt. % of an inorganic pigment. This coating is formed by using an organic material including the methyl silicone resin which is an organic compound.

The coating according to comparative example 2 was made by mixing 20 wt. % of a phenylmethyl silicone resin, 40 wt. % of toluene, 15 wt. % of a coloring pigment composed of a Mn oxide and a black pigment and 25 wt. % of an inorganic pigment. This coating is formed by using an organic material including the pheynylmethyl silicone resin which is an organic compound.

(Experiment Method)

The coatings according to the example of the present disclosure and comparative examples 1 and 2 were applied to an inner face of the tube 51 in thicknesses of 30 μm, and were calcined for an hour at a fixed temperature. Calcination temperatures of the coatings include three types of 200° C., 300° C. and 500° C. In addition, there is a concern that, when the calcination temperature of the coating exceeds 500° C., the tube 51 is deformed, and therefore an experiment was not conducted at a calcination temperature exceeding 500° C.

After the coating was calcined, the experiment device 50 was put in a test chamber of 1 $m^3$, the halogen lamp 52 was lighted up and the temperature was adjusted to 200° C. Then, a generation amount of the VOC [mg/h] and a generation amount [number] of UFP in ten minutes were measured. The VOC were measured by using a gas chromatography mass spectrometer device (manufactured by Perkin Elmer). The UFP were measured by using a real-time particle analyzer (FMPS: Fast Mobility Particle Sizer) Model 3091 (manufactured by TSI, Saint Paul, Minn., U.S.A.).

(Experiment Result)

Figure 6:
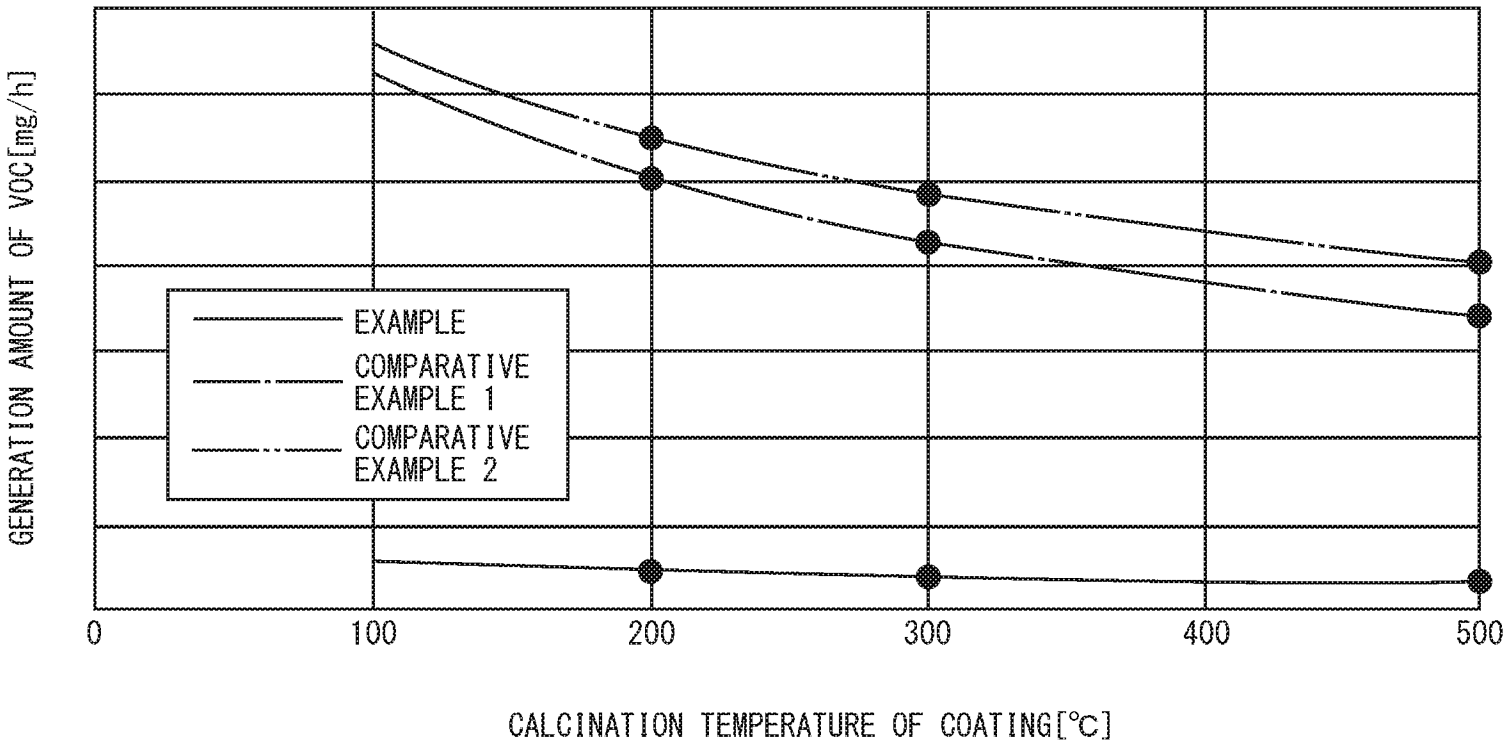
FIG. 6 is a graph showing a relationship between a calcination temperature of a coating and a generation amount of VOC.
Figure 7:
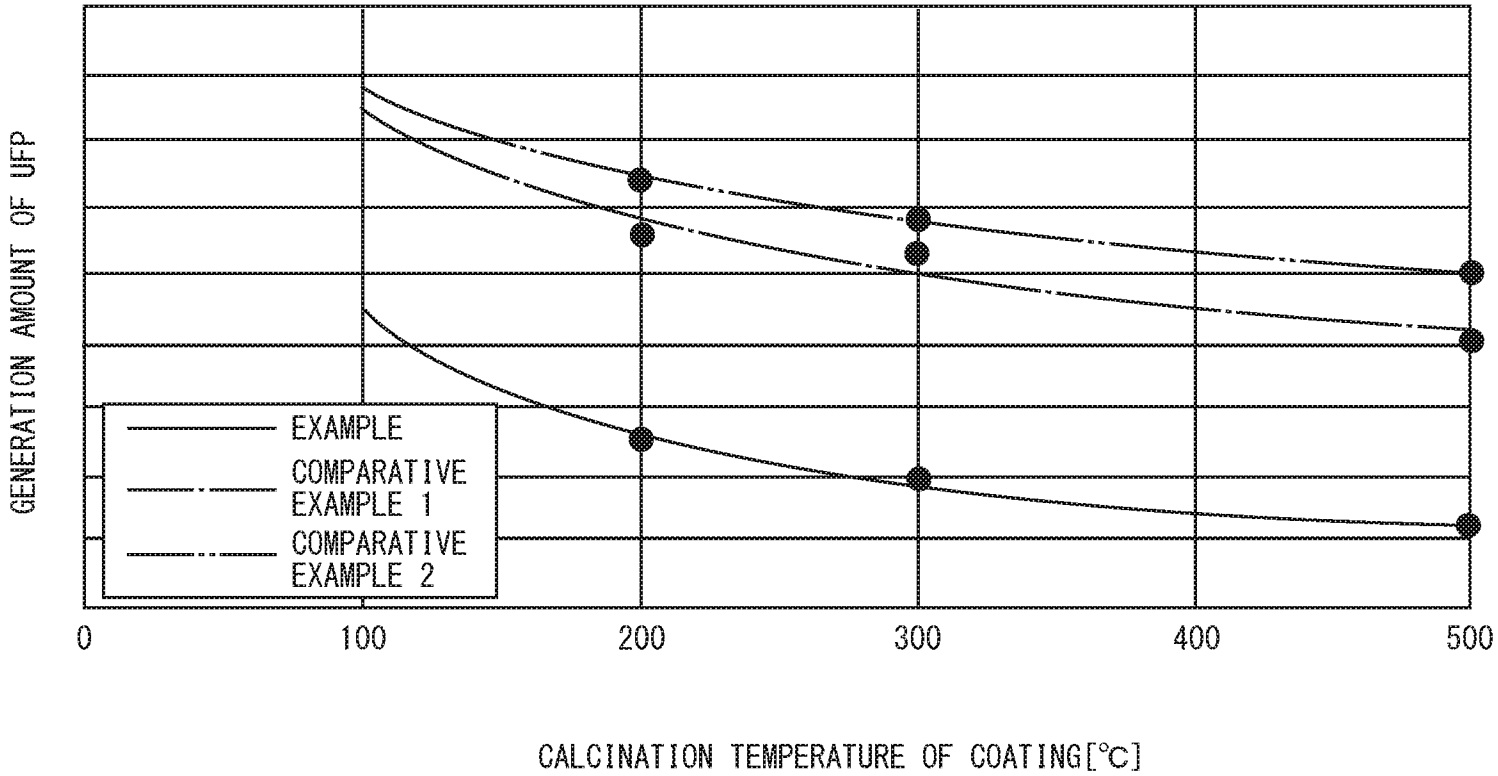
FIG. 7 is a graph showing a relationship between a calcination temperature of a coating and a generation amount of UFP.

FIGS. 6 and 7 show experiment results of this experiment. As is clear from FIGS. 6 and 7, the coating according to the example of the present disclosure generated less VOC and UFP compared to the coatings according to comparative examples 1 and 2. This is because the coating was formed by using an inorganic material and therefore generation of low molecular siloxane was restrained. In addition, it is found that, as the calcination temperature of the coating rises, the generation amount of the VOC and the UFP decrease since a dehydration condensation reaction is likely to occur when the calcination temperature of the coating rises, and a density of the coating increases. Further, the coating according to the embodiment of the present disclosure shows the effect when the calcination temperature reaches 200° C., so that it is possible to reduce an energy amount required to calcine the coating.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing member configured to be rotatable;

a pressuring member configured to be rotatable and to come into pressure contact with the fixing member so as to form a fixing nip; and a heater arranged inside the fixing member, wherein a heat resistant coating to convert light from the heater into heat is applied to an inner face of the fixing member, and the coating is formed by using an inorganic material, wherein the coating is an aqueous coating using water as a solvent and includes silica as the inorganic material, wherein the coating is composed only of the silica, the water, a coloring pigment and an extender pigment.

2. The fixing device according to claim 1, wherein the coloring pigment has a largest weight proportion among elements of the coating, and the water has a second largest weight proportion among the elements of the coating, and the silica and the extender pigment have a smallest weight proportion among the elements of the coating.

3. The fixing device according to claim 1, wherein the extender pigment includes alumina, and both of the silica and the alumina are formed by using spherical particles.

4. The fixing device according to claim 3, wherein a particle diameter range of the alumina is same as that of the silica.

5. The fixing device according to claim 1, wherein a calcination temperature T of the coating satisfies a formula of "200° C.≤T≤500° C.".

6. The fixing device according to claim 1, wherein the coating is composed only of a single layer.

7. The fixing device according to claim 1, wherein the fixing member is a fixing roller.

8. The fixing device according to claim 7, wherein the fixing roller includes:

a base material layer composed of aluminum; and an anodic oxide coating layer formed by applying alumite treatment to the base material layer, and the coating is applied on the anodic oxide coating layer.

9. The fixing device according to claim 1, wherein the fixing member is a fixing belt.

10. An image forming apparatus comprising the fixing device according to claim 1.

* * * * *